US012589780B2

(12) United States Patent
Tione

(10) Patent No.: US 12,589,780 B2
(45) Date of Patent: Mar. 31, 2026

(54) SYSTEM FOR RECOVERY OF COMPRESSED AIR RELEASED BY AIR SUSPENSIONS OF AT LEAST ONE RAILWAY VEHICLE OR TRAIN

(71) Applicant: FAIVELEY TRANSPORT ITALIA S.P.A., Piossasco (IT)

(72) Inventor: Roberto Tione, Lauriano (IT)

(73) Assignee: Faiveley Transport Italia S.P.A., Piossasco (IT)

( * ) Notice: Subject to any disclaimer, the term of this patent is extended or adjusted under 35 U.S.C. 154(b) by 581 days.

(21) Appl. No.: 18/005,557

(22) PCT Filed: Jul. 14, 2021

(86) PCT No.: PCT/IB2021/056342
§ 371 (c)(1),
(2) Date: Jan. 13, 2023

(87) PCT Pub. No.: WO2022/013772
PCT Pub. Date: Jan. 20, 2022

(65) Prior Publication Data

US 2023/0264722 A1 Aug. 24, 2023

(30) Foreign Application Priority Data

Jul. 14, 2020 (IT) ..... 102020000017020

(51) Int. Cl.
*B61F 5/10* (2006.01)

(52) U.S. Cl.
CPC ..... *B61F 5/10* (2013.01)

(58) Field of Classification Search
CPC ..... B61F 5/10; Y02T 30/00
See application file for complete search history.

(56) References Cited

U.S. PATENT DOCUMENTS 4,911,617 A * 3/1990 Buma ..... B60G 17/052 417/439
7,484,747 B2 * 2/2009 Geiger ..... B60G 17/0155 280/124.16

(Continued)

FOREIGN PATENT DOCUMENTS

DE 102009038600 A1 * 3/2011 ..... B60T 17/004
EP 4182200 B1 * 6/2025 ..... B61F 5/10

(Continued)

OTHER PUBLICATIONS

ISA European Patent Office, International Search Report Issued in Application No. PCT/IB2021/056342, Nov. 8, 2021, WIPO, 2 pages.

(Continued)

*Primary Examiner* — Jason C Smith
(74) *Attorney, Agent, or Firm* — K&L Gates LLP

(57) ABSTRACT

A system for recovery of compressed air released by air suspensions of at least one railway vehicle or train is described, comprising: a first compressor, a compressed air drying device, a first pipe, a first tank, a non-return valve, a limiting valve, a second tank, a second pipe, at least one pneumatic spring, and a first control device. The system for recovery further comprises a third pipe arranged to be connected to the pneumatic discharge port of the at least one leveling valve so as to receive compressed air discharged by the pneumatic spring, and a third tank arranged to be connected to the third pipe and to be supplied with compressed air provided by the third pipe.

6 Claims, 2 Drawing Sheets

(56) References Cited

U.S. PATENT DOCUMENTS

| | | | | |
|---|---|---|---|---|
| 10,549,766 | B2 * | 2/2020 | Yamada | B61F 5/22 |
| 11,364,939 | B2 * | 6/2022 | Sarti | B61F 5/127 |
| 2018/0297616 | A1 * | 10/2018 | Yamada | B61F 5/10 |
| 2023/0264722 | A1 * | 8/2023 | Tione | B61F 5/10<br>105/198.1 |

FOREIGN PATENT DOCUMENTS

| | | | | | |
|---|---|---|---|---|---|
| EP | 3121090 | B2 | * | 7/2025 | B61F 5/10 |
| JP | S63154782 | U | | 10/1988 | |
| JP | 2011183861 | A | * | 9/2011 | |
| JP | 2016534702 | A | * | 11/2016 | B60T 13/74 |
| JP | 201771293 | A | | 4/2017 | |
| JP | 2017071293 | A | | 4/2017 | |
| WO | WO-2012147195 | A1 | * | 11/2012 | B61F 5/10 |

OTHER PUBLICATIONS

Office Action for corresponding JP2023-501847, dated Sep. 30, 2025.

Office Action for corresponding JP2023-501847, dated Sep. 30, 2025; English translation.

* cited by examiner

SYSTEM FOR RECOVERY OF COMPRESSED AIR RELEASED BY AIR SUSPENSIONS OF AT LEAST ONE RAILWAY VEHICLE OR TRAIN

CROSS REFERENCE, TO RELATED APPLICATIONS

The present application is a U.S. National Phase of international Application No. PCT/IB2021/056342 entitled "SYSTEM FOR RECOVERY OF COMPRESSED AIR RELEASED BY AIR SUSPENSIONS OF AT LEAST ONE RAILWAY VEHICLE OR TRAIN," and filed on Jul. 14, 2021. International Application No. PCT/IB2021/056342 claims priority to Italian Patent Application No. 102020000017020 filed on Jul. 14, 2020. The entire contents of each of the above-listed applications are hereby incorporated by reference for all purposes.

TECHNICAL FIELD

The present invention is generally in the field of railway vehicles; in particular, the invention relates to a system for recovery of compressed air released by air suspensions of at least one railway vehicle or train.

PRIOR ART

An air suspension system for a bogie of a railway vehicle made according to the prior art is shown in FIG. 1.

A compressed air source 101 comprises a compressor 102 followed by a compressed air drying device 103 and supplies a tank 104, known as a main tank, through a pipe 106 known as a main pipe.

A control device 105 monitors the pressure present in the main tank 104 and controls the compressor 102 through at least one signal 106, activating the compressor 102 when the pressure in the main tank 104 has reached a minimum pressure value and deactivating the compressor 102 when the pressure in the main tank 104 has reached a maximum pressure value.

It is known to those skilled in the art in the railway sector that the minimum pressure value is normally between nominal values of 6 bar and 7 bar, and the maximum pressure value is normally between nominal values of 9 bar and 10 bar.

It is also known to those skilled in the art in the railway sector that the energy efficiency of a compressor for railway use is around 30%, i.e., the energy component comprised in the compressed air at the compressor outlet corresponds to approximately 30% of the electrical energy used by the compressor to generate the compressed air. The remaining approximately 70% is converted to heat during compression, and then dispersed into the environment.

The control device 105 may take a variety of embodiments, such as, by way of non-exclusive example, an electromechanical pressure switch or again by way of non-exclusive example, an electronic control system.

Downstream of the compressor 102, the compressed air drying device 103 is used to remove liquid components and water vapor present in the compressed air generated by the compressor 102.

It is known to those skilled in the art that the drying process uses and disperses into the atmosphere part of the compressed air generated by the compressor 102 in an amount equal to about 15% of the compressed air to be dried.

Considering the various efficiencies previously described, the compressed air stored in the tank 104 has a mechanical energy corresponding to about 25% of the electrical energy used by the compressor 102 to bring the air in the main tank 104 to a pressure value between 9 bar and 10 bar.

Through the main pipe 106, the compressed air is brought to at least one first utility system 203, such as, by way of non-exclusive example, the brake system, a pantograph lift system, other users. It is not the object of the present invention to go into detail regarding the implementation of the various user systems 203.

An additional system using compressed air is the air suspension system described below.

Downstream of a non-return valve 107, a limiting valve 108 supplies a tank 109.

The object of the limiting valve 108 is to limit the pressure to the maximum value allowed by the suspension system. An exemplifying value is between 6 bar and 7 bar. The maximum allowable design pressure value for the suspension system determines the minimum design pressure value at which the control device 105 activates the compressor 102.

A leveling valve 110 is supplied by the tank 109 and supplies the pneumatic spring 111, which is physically constrained between the bogie 115 and the vehicle carriage 113.

The operation of the leveling valve 110, shown below, is known in the art.

The leveling valve 110 is arranged to assume three states, imposed by a lever 114.

In a first position, the lever 114 forces the leveling valve 110 to connect the tank 109 with the pneumatic spring 111, increasing the pressure in the pneumatic spring 111, raising the vertical position of the carriage 113 relative to the level of the rail.

In a second central position, the lever 114 forces the leveling valve 110 to close the outlet of the tank 109 and the inlet of the pneumatic spring 111, respectively, keeping the pressure in the pneumatic spring 111 constant and thereby maintaining a constant vertical position of the carriage 113 relative to the level of the rail.

In a third position, the lever 114 forces the leveling valve 110 to close the outlet of the tank 109 and bring the pneumatic spring 111 into communication with the atmosphere through the pneumatic discharge port 112 of the leveling valve 110, reducing the vertical position of the carriage 113 relative to the level of the rail.

It is known in the art how the leveling valve 110 is mechanically connected to the vehicle carriage 113 and the vertex 114 of the lever 113 is mechanically connected to the bogie 115.

Thus, as the weight of the carriage 113 varies due to a greater or lesser number of passengers, the relative vertical movement between the carriage 113 and the bogie 115 acts on the lever 113 in such a way as to continuously bring the distance between the carriage 113 and the bogie 115 to a value predetermined in the design stage, corresponding to the second central position of the leveling valve 110.

For the sake of completeness of information, said predetermined value of the vertical distance between the carriage 113 and the bogie 115 corresponds to the height of the passenger boarding and alighting platform at the station, which must regularly coincide with the level of the internal plane of the vehicle, in order to avoid undue steps between the vehicle and the platform at the transit of passengers in the two directions.

It is known that, generally, the working range of an air suspension system is between 4 bar and 6 bar, i.e., in the stage of discharging to the atmosphere, the leveling valve 110 releases compressed air to the atmosphere in a pressure range typically between 4 bar and 6 bar.

It is known drat oscillations of the vehicle during travel cause changes in relative height between the carriage 113 and the bogie 115 such that the leveling valve 110 is activated, causing undue air consumption.

It is known that the air consumption of the suspension system of a railway vehicle corresponds on average to 60% of the air produced by the compressed air generation system 101.

Disadvantageously, this compressed air consumption by the suspension system has a considerable value.

SUMMARY OF INVENTION

Thus, one object of the present invention is to recover some of the compressed air used by the suspension system, and consequently to recover energy.

The aforesaid and other objects and advantages are achieved, according to an aspect of the invention, by a system for recovery of compressed air released by air suspensions of at least one railway vehicle or train having the features defined in claim 1. Preferred embodiments of the invention are defined in the dependent claims, the content of which is to be understood as an integral part of this description.

BRIEF DESCRIPTION OF THE DRAWINGS

Functional and structural features of some preferred embodiments of a system for recovery of compressed air released from air suspensions of at least one railway vehicle or train according to the invention will now be described. Reference is made to the appended drawings, wherein.

DETAILED DESCRIPTION

Figure 1:
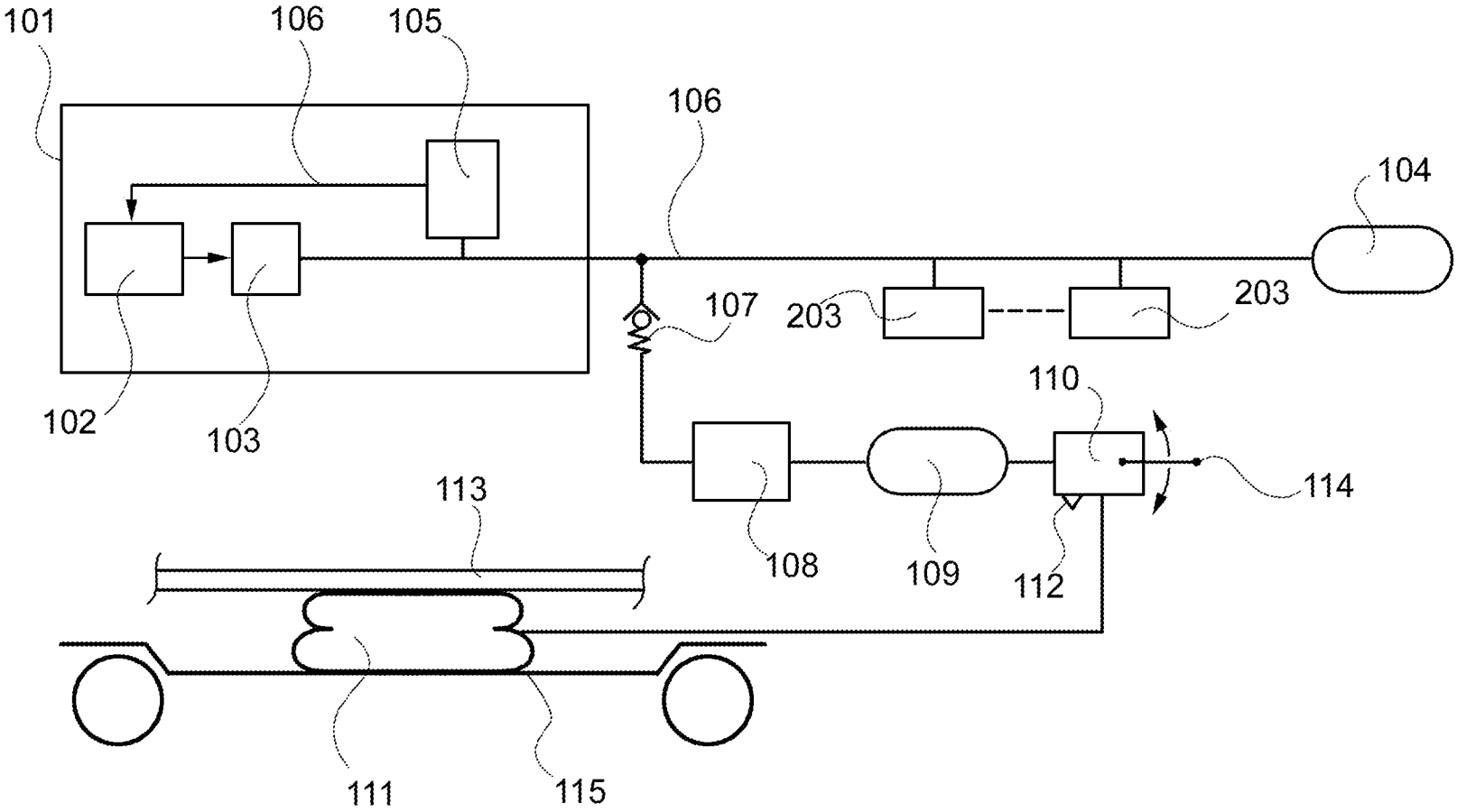
FIG.1 (PRIOR ART)
FIG. 1 illustrates an air suspension system for a bogie of a railway vehicle, made according to the prior art.

Before describing a plurality of embodiments of the invention in detail, it should be clarified that the invention is not limited in its application to the construction details and configuration of the components presented in the following description or illustrated in the drawings. The invention may assume other embodiments and be implemented or constructed in practice in different ways. It should also be understood that the phraseology and terminology have a descriptive purpose and should not be construed as limiting. The use of "include" and "comprise" and their variations is to be understood as encompassing the elements set out below and their equivalents, as well as additional elements and the equivalents thereof.

Figure 2:
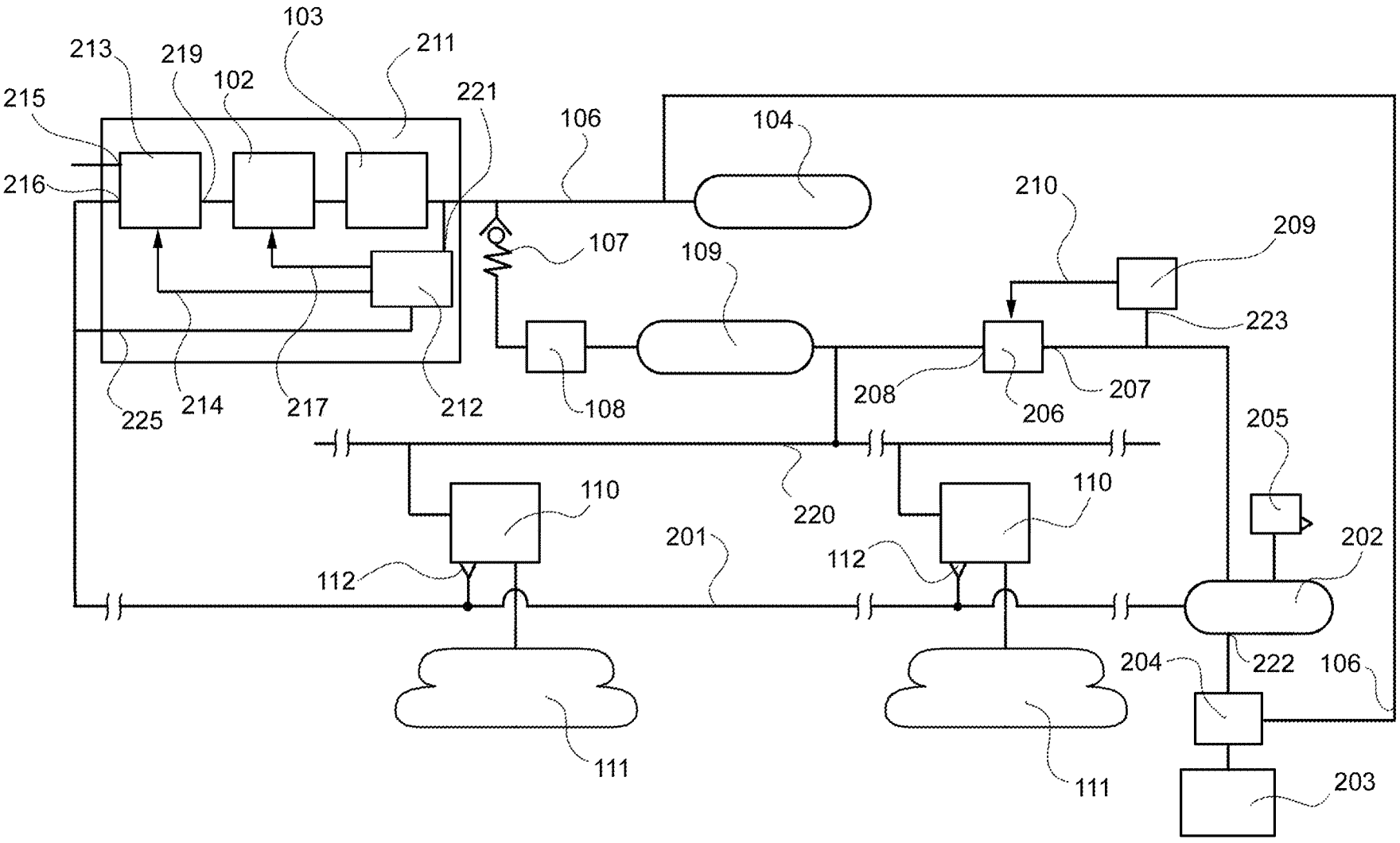
FIG. 2 illustrates one embodiment of a system for recovery of compressed air released by air suspensions of at least one railway vehicle or train.

As observable in FIG. 2, in a first embodiment, a system for recovery of compressed air released by air suspensions of at least one railway vehicle or train comprises a first compressor 102 arranged to be supplied by atmospheric pressure and to generate compressed air, a compressed air drying device 103 arranged to be supplied with compressed air provided by said first compressor 102, a first pipe 106 arranged to be supplied with compressed air provided by said compressed air drying device 103, and a first tank 104 arranged to be supplied with compressed air provided by the first pipe 106. In other words, a compressed air source 211 comprises the first compressor 102 followed by the compressed air drying device 103 and supplies the first tank 104 through the first pipe 106. The first tank 104 is known to those skilled in the art as the main tank and the first pipe 106 is known to those skilled in the art as the main pipe. Downstream of the first compressor 102, the compressed air drying device 103 is used to remove liquid components and water vapor present in the compressed air generated by the first compressor 102.

The system for recovery further comprises a first control device 212 including a first pneumatic inlet 221 connected to the first pipe 106, wherein the first control device 212 is arranged to activate the first compressor 102 through a first control signal 217 when the pressure present in the first pipe 106 is equal to or less than a predetermined first minimum pressure value, and the first control device 212 is arranged to deactivate the first compressor 102 through the first control signal 217 when the pressure present in the first pipe 106 is equal to or greater than a predetermined first maximum pressure value.

In other words, the first control device 212, through a first pneumatic inlet 221 connected to the first tank 106, monitors the pressure present in the first tank 104 and controls the first compressor 102 through the at least one first control signal 217, activating the first compressor 102 when the pressure in the first tank 104 has reached a first minimum pressure value and deactivating the first compressor 102 when the pressure in the first tank 104 has reached a first maximum pressure value. It is known to those skilled in the art in the railway sector that the first minimum pressure value may be, not exclusively, between nominal values 6 bar and 7 bar, and the first maximum pressure value may be, not exclusively, between nominal values 9 bar and 10 bar.

Further, the system for recovery also comprises a non-return valve 107 arranged to be supplied with compressed air provided by the first pipe 106, a limiting valve 108 arranged to be supplied with compressed air provided by the non-return valve 107, a second tank 109 arranged to be supplied with compressed air provided by the limiting valve 108, and a second pipe 220 arranged to be supplied with compressed air provided by the second tank 109.

In other words, the non-return valve 107 connected to the first pipe 106 supplies the pressure limiting valve 108. The pressure limiting valve 108 in turn supplies the second tank 109 and a second pipe 220.

Still further, the system for recovery includes at least one leveling valve 110 arranged to be supplied with compressed air provided by the second pipe 220 and at least one pneumatic spring 111 arranged to be supplied by compressed air provided by the leveling valve 110. The pneumatic spring 111 is arranged to be interposed between a bogie 115 and the carriage 113 of said at least one railway vehicle or railway vehicle of said train. The at least one leveling valve 110 includes a pneumatic discharge port 112 arranged to discharge compressed air stored in the pneumatic spring 111.

In other words, the at least one first leveling valve 110, the operation of which has been heretofore described, supplied by the second pipe 220, i.e., the second tank 109, supplies a first pneumatic spring 111 located between the associated bogie 115 and the associated vehicle carriage 113, which are not illustrated in FIG. 2.

Additional leveling valves 110 may be supplied by the second pipe 220 and supply respective pneumatic springs 111.

Lastly, the system for recovery further includes a third pipe 201 arranged to be connected to the pneumatic discharge port 112 of the at least one leveling valve 110 so as to receive compressed air discharged from the pneumatic spring 111, and a third tank 202 arranged to be connected to the third pipe 201 and to be supplied with compressed air provided by the third pipe 201.

In other words, with respect to the system of the conventional prior art heretofore described, which provides for the discharge of air to the atmosphere by the at least one leveling valve 110 through the pneumatic discharge port 112, in the present invention, there is a connection of the pneumatic discharge port 112 of the at least one first leveling valve 110 to a third tank 202 through a third pipe 201.

Thus, air that is discharged by the at least one leveling valve 110 is not discharged into the atmosphere but is collected in the third tank 202 through the third pipe 201

Where more than one leveling valve 110 is present, all pneumatic discharge ports 112 associated with each leveling valve 110 are connected to said second pipe 201.

With each pressure release action by the at least one leveling valve 110, the pressure in the third volume 202 increases.

The third tank 202 may include a pneumatic outlet 222 arranged to supply at least partially the compressed air to the third tank 202 to at least one pneumatic user system 203 of the at least one railway vehicle.

The pneumatic outlet 222 may be arranged to supply compressed air provided by the third tank 202 directly to the at least one pneumatic user system 203, or, the pneumatic outlet 222 may be arranged to supply compressed air provided by the third tank 202 to the at least one pneumatic user system 203 through a pneumatic control device 204 arranged to connect the pneumatic user system 203 to the first pipe 106, if the pressure present in the third tank 202 is less than a predetermined value, which would be insufficient to properly supply the pneumatic user system 203.

In other words, the at least one pneumatic user system 203 may be connected directly or through a pneumatic control device 204 to the third tank 202, from which it draws compressed air for its own operation, reducing the pressure in the third tank 202. The pneumatic control device 204 is intended to connect the pneumatic user system 203 to the first pipe 106, or to additional intermediate compressed air tanks not illustrated in FIG. 2 and interposed between the first pipe 106 and the pneumatic user system 203 if the pressure present in the third tank 202 is below a value insufficient to properly supply the system 203.

Advantageously, the compressed air discharged by the at least one leveling valve 110 is not dispersed through the immediate expansion to the atmosphere but is recovered and utilized by the pneumatic user system 203. Additionally, the compressed air does not require drying as it is already dry from a drying process present at the source 101. All of this increases the overall efficiency of the overall compressed air generation and utilization system.

The system for recovery may comprise a safety device 205, calibrated to a safely pressure value less than or equal to a minimum nominal working pressure value of the at least one pneumatic spring 111. The safety device 205 may then be arranged to discharge the air accumulated in the third tank 202 into the atmosphere when the pressure in the third tank 202 exceeds the safety pressure value.

In other words, in the event that the at least one pneumatic user system 203 does not rapidly utilize the compressed air stored in the at least one pneumatic tank 202, a safety device 205, calibrated to a safety pressure value less than or equal to the minimum nominal working pressure value of the at least one pneumatic spring iii, discharges the air stored in the third tank 202 to the atmosphere when the pressure in the third tank 202 exceeds the safety pressure value, preventing a pressure increase beyond said safety pressure value from preventing the proper operation of the at least one pneumatic spring 111.

Said safety device 205 may not be exclusively a pneumatic safety valve.

In a further embodiment, the system for recovery may include a second compressor 206, which includes a suction inlet 207 arranged to be supplied with compressed air provided by the third tank 202, and an outlet port 208 arranged to supply compressed air to the second tank 109. Thus, the system for recovery may comprise a second control device 209 and includes a pneumatic inlet 223 arranged to be connected to the third tank 202. The second control device 209 may then be arranged to activate said second compressor 206 through a second control signal 210 when the pressure present in said third tank 202 is equal to or greater than a predetermined second maximum pressure value, and to deactivate said second compressor 206 through said second control signal 210 when the pressure present in said third tank 202 is equal to or less than a predetermined second minimum pressure value.

In other words, the second compressor 206 may have its inlet port 207 connected to the third tank 202 and its outlet port 208 connected to the second tank 109. The second control device 209 may be connected to the third tank 202 through a second pneumatic inlet 223, and may monitor the pressure present in the third tank 202 and control the compressor 206 through the at least one second control signal 210, activating the second compressor 206 when the pressure in the third tank 202 has reached a second maximum pressure value, equal to or less than the minimum nominal operating value of the at least one pneumatic spring 111, and deactivating the second compressor 206 when the pressure in the third tank 202 has reached a second minimum pressure value predetermined in the design stage, less than the minimum nominal operating value of the at least one pneumatic spring 111.

Advantageously, the compressed air discharged by the at least one leveling valve 110 is not dispersed through immediate expansion to the atmosphere but is recovered by recirculation through a significantly smaller pressure drop relative to the initial pressure drop.

Purely by way of example, in a system such as the one described in this embodiment, in which a pneumatic suspension system operates between 4 bar and 6 bar, after a first cycle performed by the first compressor 102 to bring air into the first tank 104 through a first jump from 0 bar to 10 bar, a normal operating cycle performed by the second compressor 206 will be established to bring air from the pressure present in the third tank 202 to the pressure of 6 bar in the second tank 109.

Additionally, said compressed air does not require drying as it is already dry from a drying process present at the source 101.

In yet another embodiment, the system for recovery may comprise a pneumatic switching device 213.

The pneumatic switching device 213 may include a first suction port 215 arranged to draw air from the atmosphere and a second suction port 216 arranged to be connected to and draw air from said third pipe 201.

The pneumatic switching device 213 may include an outlet 219 connected to the suction inlet of the first compressor 102. The pneumatic switching device 213 may be arranged to be controlled by a third control signal 214 generated by the first control device 212. The third control signal may be arranged to assume a first state through which it controls the pneumatic switching device 213 so as to connect the suction inlet of the first compressor 102 to the first suction port 215 to draw air from the atmosphere, and a second state through which it controls the pneumatic switching device 213 so as to connect the suction inlet of the first compressor 102 to the second suction port 216 to draw air from the third pipe 201.

The first control device 212 may include a second pneumatic inlet 225 arranged to be connected to the third pipe 201.

The first compressor 102 may present an initial operating status. That is, it may initially be in a state in which it is on or in a state in which it is off. Thus, the first control device 212 may be arranged to:

a) when the pressure in the third pipe 201, or in the third tank 202, is equal to or greater than said second maximum pressure value to cause the third control signal 214 to assume its second state so as to control the pneumatic switching device 213 so as to connect the inlet of the first compressor 102 to the third pipe 201 through the second suction port 216, and to bring the first compressor 102 into a current operating state in which said first compressor is on, if said initial operating state of the first compressor 102 is a state in which said first compressor 102 is off, or to leave the first compressor 102 in a current operating state in which said first compressor is on, if said initial operating state of the first compressor 102 is a state in which said first compressor 102 is already on;

b) when the pressure in the third pipe (201), or in the third tank (202), is equal to or less than said second minimum pressure value to cause the third control signal 214 to assume its first state so as to control the pneumatic switching device 213 so as to connect the inlet of the first compressor 102 to the atmosphere through the first suction port 215, and to bring the first compressor 102 back to a current operating state in which said first compressor is on, if said initial operating state of the first compressor 102 was a state in which said first compressor 102 was on, or to bring the first compressor 102 back to a current operating state in which said first compressor is off, if said initial operating state of the first compressor 102 was a state in which said first compressor 102 was off (i.e., returns the compressor to its previous condition).

In other words, normally, the first compressor 102 may perform its usual function of filling the first tank 104 through the first suction port 215, for example, turning on at 6 bar and turning off at 10 bar (typical values).

Regardless of that which the first compressor 102 is doing, if the pressure in the third pipe 201, i.e., in the third tank 202, has reached its maximum value indicative of the fact that air has been recovered from the pneumatic spring 111 (i.e., from the suspensions) up to a level beyond which the pneumatic spring 111 may no longer be discharged, priority may be given to returning the air recovered from the third tank 202 to the first tank 104 104, switching the outlet 219 (connected to the suction inlet of said first compressor 102) to the second suction port 216 and reactivating the first compressor 102, if it was not already active.

When the third tank 202 has reached its predetermined minimum pressure, the first compressor 102 may go back to doing that which it was doing, i.e., if it was off it will turn back on and if it was active to pump air into the first tank 104 from the first suction port 215, it will go back to being active to pump air into the first tank 104 from the first suction port 215, until the pressure in the first pressure 104 has reached its maximum pressure.

Therefore, the first compressor 102 may compress air from the pneumatic switching device 213 arranged to receive the third control signal 214. The pneumatic switching device 213 may be, by way of example, a pneumatic valve with a capacity appropriate to the suction post of the first compressor 102. The third control signal 214 may assume a first state in which it controls the pneumatic switching device 213 so as to connect the inlet of the compressor 102 to the atmosphere through the first suction port 215 and may assume a second state in which it controls the pneumatic switching device 213 so as to connect the inlet of the first compressor 102 to the third pipe 201 through the second suction port 216.

The first control device 212, through the second pneumatic inlet 225, may further monitor the pressure present in the third tank 202 or in the third pipe 201 (the pressure in the third pipe 201 being substantially the same as the pressure in the third tank 202), i.e., and control the pneumatic switching device 213 through the third control signal 214. When the pressure in the third tank 202 has reached a second minimum pressure value, regardless of the current state of the first control signal 217 and the third control signal 214, the first control device 212 controls the third control signal 214 in its second state in which it controls the pneumatic switching device 213 so as to connect the inlet of the first compressor 102 to the third pipe 201 through the second suction port 216, and, if the first compressor 102 has not yet been activated, activates the compressor 102.

When the pressure in the third tank 202 has reached a second maximum pressure value, it returns the first control signal 217 and the third control signal 214 to their previous state.

Advantageously, the compressed air discharged by the at least one leveling valve 110 is not dispersed through immediate expansion to the atmosphere but is recovered by recirculation through a smaller pressure drop than the initial pressure drop. Additionally, said compressed air does not require drying as it is already dry from a drying process present at the source 101.

It will appear obvious to a person skilled in the art that the first compressor 102, the compressed air drying device 103, the first pipe 106, the first tank 104, the non-return valve 107, the limiting valve 108, the second tank 109, the second pipe 220, the leveling valve 110, the pneumatic spring 111, and the control device 212, referred to above in reference to the system for recovery, may be considered equivalently belonging to an air suspension system, i.e., the air suspensions, with which the system for recovery comprising the third pipe 201 and the third tank 202 may be associated, without thereby departing from the scope of the present invention. Clearly, the system for recovery comprising the third pipe 201 and the third tank 202 may also be associated with pneumatic suspension systems that are structurally different but equally compatible in that they are provided with at least one pneumatic discharge port of a leveling valve adapted to be connected to the pipe 201 of the system for recovery so as to receive the compressed air discharged by the at least one pneumatic spring, without thereby departing from the scope of the present invention.

That which has been described above in reference to the sector of railway vehicles, where applicable, may also find application in other sectors, such as, for example, the generic vehicle, rubber-tired vehicle, or rubber-tired convoy sector.

Various aspects and embodiments of a system for recovery of compressed air released from air suspensions of at least one railway vehicle according to the invention have been described. It is understood that each embodiment may be combined with any other embodiment. Furthermore, the invention is not limited to the described embodiments, but may be varied within the scope defined by the appended claims.

The invention claimed is:

1. A system for recovery of compressed air released by air suspensions of at least one railway vehicle or train, comprising:

a first compressor arranged to be supplied by atmospheric pressure and to generate compressed air;

a compressed air drying device arranged to be supplied with compressed air provided by said first compressor;

a first pipe arranged to be supplied with compressed air provided by said compressed air drying device;

a first tank arranged to be supplied with compressed air provided by said first pipe;

a non-return valve arranged to be supplied with compressed air provided by said first pipe;

a pressure limiting valve arranged to be supplied with compressed air provided by said non-return valve;

a second tank arranged to be supplied with compressed air provided by said pressure limiting valve;

a second pipe arranged to be supplied with compressed air provided by said second tank;

at least one leveling valve arranged to be supplied with compressed air provided by said second pipe;

at least one pneumatic spring arranged to be supplied with compressed air provided by said leveling valve, wherein the pneumatic spring is arranged to be interposed between a bogie of at least one railway vehicle and a carriage of said at least one railway vehicle, wherein said at least one leveling valve includes a pneumatic discharge port arranged to discharge compressed air accumulated in said pneumatic spring;

a first control device including a first pneumatic inlet connected to said first pipe, wherein said first control device is arranged to activate said first compressor by means of a first control signal when the pressure present in the first pipe is equal to or lower than a predetermined first minimum pressure value, and said first control device is arranged to deactivate said first compressor by means of said first control signal when the pressure present in the first pipe is equal to or greater than a predetermined first maximum pressure value;

said system for recovery comprising:

a third pipe arranged to be connected to said pneumatic discharge port of the at least one leveling valve, so as to receive the compressed air discharged by said pneumatic spring; and a third tank arranged to be connected to said third pipe and to be supplied with compressed air provided by said third pipe.

2. The system for recovery of compressed air according to claim 1, wherein said third tank includes a pneumatic outlet arranged to at least partially provide the compressed air in the third tank directly to at least one pneumatic user system of the at least one railway vehicle or train.

3. The system for recovery of compressed air according to claim 2, wherein the pneumatic outlet of said third tank is arranged to provide the compressed air in the third tank directly to the at least one pneumatic user system; or, the pneumatic outlet of said third tank is arranged to provide the compressed air in the third tank to the at least one pneumatic user system through a pneumatic control device arranged to connect the pneumatic user system to the first pipe, if the pressure present in the third tank is lower than a predetermined value, which would be insufficient to correctly supply the pneumatic user system.

4. The system for recovery of compressed air according to claim 1, comprising a second compressor including:

a suction inlet arranged to be supplied with the compressed air provided by said third tank; and an outlet port arranged to supply compressed air to said second tank;

wherein said system for recovery of compressed air comprises a second control device including a pneumatic inlet arranged to be connected to said third tank;

wherein said second control device is arranged to activate said second compressor by means of a second control signal when the pressure present in said third tank is equal to or greater than a predetermined second maximum pressure value, and to deactivate said second compressor by means of said second control signal when the pressure present in said third tank is equal to or lower than a predetermined second minimum pressure value.

5. The system for recovery of compressed air according to claim 1, comprising a pneumatic switching device including:

a first suction port arranged to draw air from the atmosphere; and a second suction port arranged to be connected to said third pipe and to draw air from said third pipe;

wherein said pneumatic switching device includes an outlet connected to a suction inlet of said first compressor;

wherein said pneumatic switching device is arranged to be controlled by a third control signal generated by said first control device;

wherein said third control signal is arranged to assume:

a first state through which it controls the pneumatic switching device so as to connect the suction inlet of said first compressor to said first suction port to draw air from the atmosphere;

a second state through which it controls said pneumatic switching device so as to connect the suction inlet of said first compressor to said second suction port to draw air from said third pipe;

wherein the first control device includes a second pneumatic inlet arranged to be connected to said third pipe;

wherein the first compressor has an initial operating state, the first control device being arranged to:

a) when the pressure in the third pipe, or in the third tank, is equal to or greater than a second maximum pressure value, cause the third control signal to assume its second state so as to control the pneumatic switching device so as to connect the suction inlet of the first compressor to the third pipe through the second suction port, and bring the first compressor into a current operating state in which said first compressor is on, if said initial operating state of the first compressor was a state in which said first compressor was off or to leave the first compressor in a current operating state in which said first compressor is on, if said initial operating state of the first compressor was a state in which said first compressor was already on;

b) when the pressure in the third pipe, or in the third tank, is equal to or lower than a second minimum pressure value, cause the third control signal to assume its first state so as to control the pneumatic switching device so as to connect the suction inlet of the first compressor to the atmosphere through the first suction port, and return the first compressor to a current operating state in which said first compressor is on, if said initial operating state of the first compressor was a state in which said first compressor was on or to return the first compressor into a current operating state in which said first compressor is off, if said initial operating state of the first compressor was a state in which said first compressor was off.

6. The system for recovery of compressed air according to claim 5, comprising a safety device, calibrated at a safety pressure value lower than or equal to a nominal minimum working pressure value of the at least one pneumatic spring;

the safety device being arranged to discharge the air accumulated in the third tank to the atmosphere when the pressure in the third tank exceeds the safety pressure value.

* * * * *